US007316583B1

(12) United States Patent
Mistarz

(10) Patent No.: US 7,316,583 B1
(45) Date of Patent: Jan. 8, 2008

(54) FIELD WIREABLE NETWORK PLUG

(75) Inventor: Bruce E. Mistarz, Gainesville, GA (US)

(73) Assignee: Mencom Corporation, Gainesville, GA (US)

( * ) Notice: Subject to any disclaimer, the term of this patent is extended or adjusted under 35 U.S.C. 154(b) by 0 days.

(21) Appl. No.: 11/507,978

(22) Filed: Aug. 22, 2006

(51) Int. Cl.
*H01R 13/40* (2006.01)

(52) U.S. Cl. ..... 439/589; 439/344; 439/320

(58) Field of Classification Search ..... 439/589, 439/344, 320, 587, 588, 584, 583, 519, 521
See application file for complete search history.

(56) References Cited

U.S. PATENT DOCUMENTS

| | | | | |
|---|---|---|---|---|
| 5,538,438 | A * | 7/1996 | Orlando | 439/344 |
| 6,582,248 | B2 * | 6/2003 | Bachman | 439/462 |
| 6,595,791 | B2 | 7/2003 | Below et al. | 439/271 |
| 6,796,844 | B1 * | 9/2004 | Edwards, III | 439/638 |
| 7,018,226 | B2 * | 3/2006 | Milner et al. | 439/321 |
| 2005/0064752 | A1 * | 3/2005 | Serino | 439/320 |
| 2006/0166554 | A1 * | 7/2006 | Hung | 439/589 |

OTHER PUBLICATIONS http://www.rjfield.com/ethernet_connectors_rif_en.htm, "Connettori Ethernet—Amphenol Socapex", 2002-2003, 2 pgs.
www.rjlnxx.com, "Physical Media", 2002, 2 pgs.
www.siemon.com, "Industrial MAX® 5e Screened Plug Instructions," The Siemon Company, 2002, 2 pgs.
www.mencom.com, Mencom Corporation, Industrial Connection Products, "Ethernet Series Etherlink V1 Field Wireable" and "Ethernet Series Etherlink V1 Cordsets", pp. 117-118.

* cited by examiner

*Primary Examiner*—Gary Paumen
(74) *Attorney, Agent, or Firm*—Merchant & Gould

(57) ABSTRACT

A field wireable network plug may be provided. The field wireable network plug may include a body having a first end and a second end. The body may comprise an opening passing through the body from the first end of the body to the second end of the body. The opening may be configured to allow a connector to pass through the opening from the first end of the body to the second end of the body. The body may also include at least one recess into the body at the second end of the body. The recess may be configured to restrict the connector from moving through the opening from the second end of the body to the first end of the body.

17 Claims, 10 Drawing Sheets

CONNECTOR ROTATED AFTER BEING PUSHED COMPLETELY THROUGH CONNECTOR

FIELD WIREABLE NETWORK PLUG

BACKGROUND

Computers, controllers and other electronic equipment (hereinafter referred to as Electronic Equipment) in industrial environments may be networked over cables. Unfortunately, networked electronic equipment used in industrial environments are susceptible to dust and moisture intrusion from the industrial environment in which they are used. For example, networked electronic equipment may be used to control an assembly line's operation. Because many of the connections necessary to connect the electronic equipment may be on the factory floor along with the assembly line controlled, the electronic equipment may operate in the factory floor environment. Many times this may mean that the electronic equipment and their corresponding connections are exposed to moist and/or dusty production process as well as cleaning processes.

Due to the aforementioned dust and moisture intrusion problems, connection types normally used, for example, in an office environment, may fail due to the aforementioned dust and moisture intrusion. Yet, these same "office environment" connectors are the standard and many times the most desired connectors to connect some of these pieces of electronic equipment. Due to the time, cost and difficulty involved in making these assemblies on the factory floor, not to mention the cost of the testing equipment necessary to insure the finished cables will perform properly, most users of industrial Ethernet products purchase very expensive pre-made cables. This solution does not afford the user the ability to use the low cost, mass produced cables that are generally used in the office environments that are readily available through many different outlets.

SUMMARY

A field wireable network plug may be provided. This Summary is provided to introduce a selection of concepts in a simplified form that are further described below in the Detailed Description. This Summary is not intended to identify key features or essential features of the claimed subject matter. Nor is this Summary intended to be used to limit the scope of the claimed subject matter.

A field wireable network plug may be provided. The field wireable network plug may include a body having a first end and a second end. The body may comprise an opening passing through the body from the first end of the body to the second end of the body. The opening may be configured to allow a connector to pass through the opening from the first end of the body to the second end of the body. The body may also include at least one recess into the body at the second end of the body. The recess may be configured to restrict the connector from moving through the opening from the second end of the body to the first end of the body.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various features combinations and sub-combinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
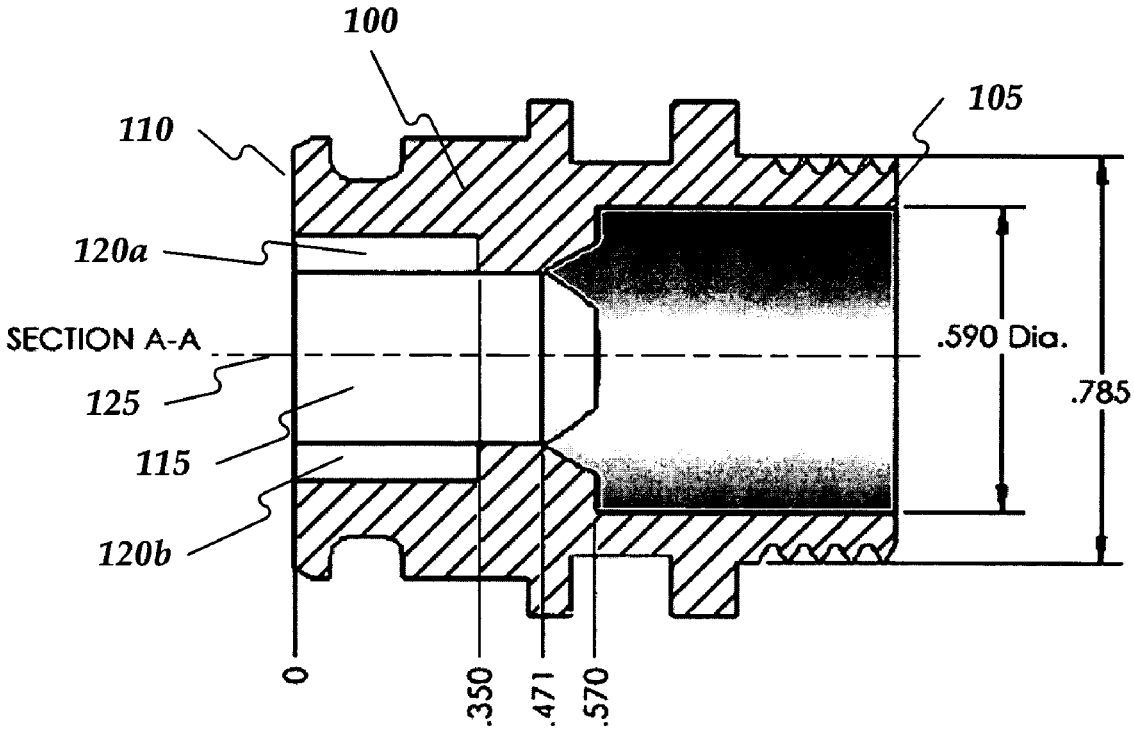
FIG. 1 is a diagram of a body.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

Consistent with an embodiment of the invention, a field wireable network plug may be provided. The plug may allow an inexpensive pre-tested off-the-shelf cable to be used to connect a network in, for example, an industrial environment susceptible to dust and moisture. The plug, for example, may include a body. The body may include an opening that may allow a connector, with a cable connected to it, to pass from a first end of the body to a second end of the body. Once the connector is past the second end, the connector may be rotated and then pulled back through the body for a distance until it seats into a recess. After the connector is seated in the recess, the cable connected to the cable, may be held under tension in order to keep the connector firmly seated in the recess. In order to keep the cable under tension, a tensioning component may be used. The tensioning component may comprise a grommet and nut applied, for example, at the first end of the body. After the connector is held in the plug by the tensioning component, the connector may be inserted into a receptacle. In addition, a coupling nut located at the body's second may be attached to the receptacle. Once attached, the coupling nut attached to the receptacle may form a dust resistant and/or water resistant seal between the plug and the receptacle. In this way, the connection between the connector and the receptacle may be keep free from dust and moisture making the connection less susceptible to failure due to contamination.

Figures 2A, 2B, 2C:
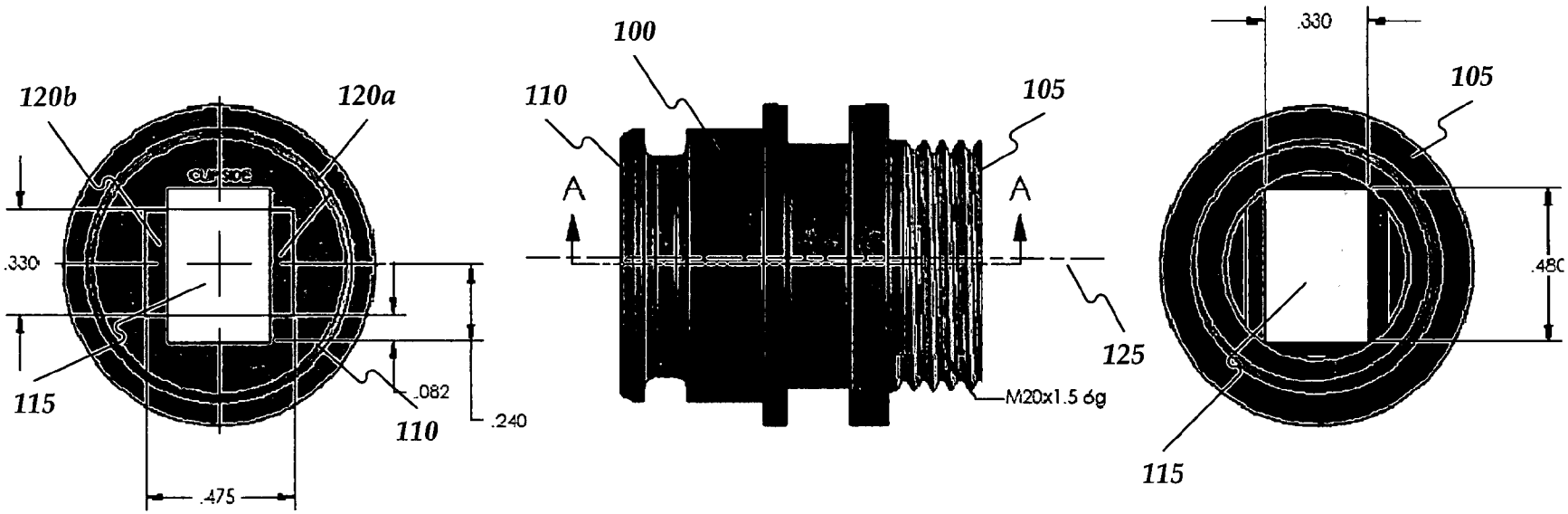
FIGS. 2A through 2C are diagrams showing various views of the body shown in FIG. 1.

FIG. 1 shows a body 100 consistent with embodiments of the invention. As shown in FIG. 1, body 100 may have a first end 105 and a second end 110. Body 100 may further comprise an opening 115 passing through body 100 from first end 105 to second end 110. Opening 115 may be configured to allow a connector (not shown) to pass through opening 115 from first end 105 of body 100 to second end 110 of body 100. FIG. 1 shows an axis 125 passing through opening 115's center. Moreover, body 100 may further comprise at least one recess into body 100 at second end 110 of body 100. As described in more detail below with respect to FIG. 3, the recess may be configured to restrict the connector from moving through opening 115 from second end 110 of body 100 to first end 105 of body 100. FIGS. 2A through 2C are diagrams showing various views of body 100 from FIG. 1 in more detail.

The at least one recess may comprise, but is not limited to, one of a recess 120*a* and/or a recess 120*b*. Because the at least one recess may be configured to restrict the connector from moving through opening 115 from second end 110 of body 100 to first end 105 of body 100, the at least one recess may comprise any shape, size, or quantity. For example, while FIGS. 1 and 2 show two recesses (i.e. recess 120*a* and recess 120*b*), consistent with embodiments of the invention, there may be any number of recesses. Also, while FIGS. 1 and 2 show the at least one recess as being rectangular, it may be any shape. For example, the at least one recess may complies a circular shelf about opening 115 or any other shape.

Figure 3:
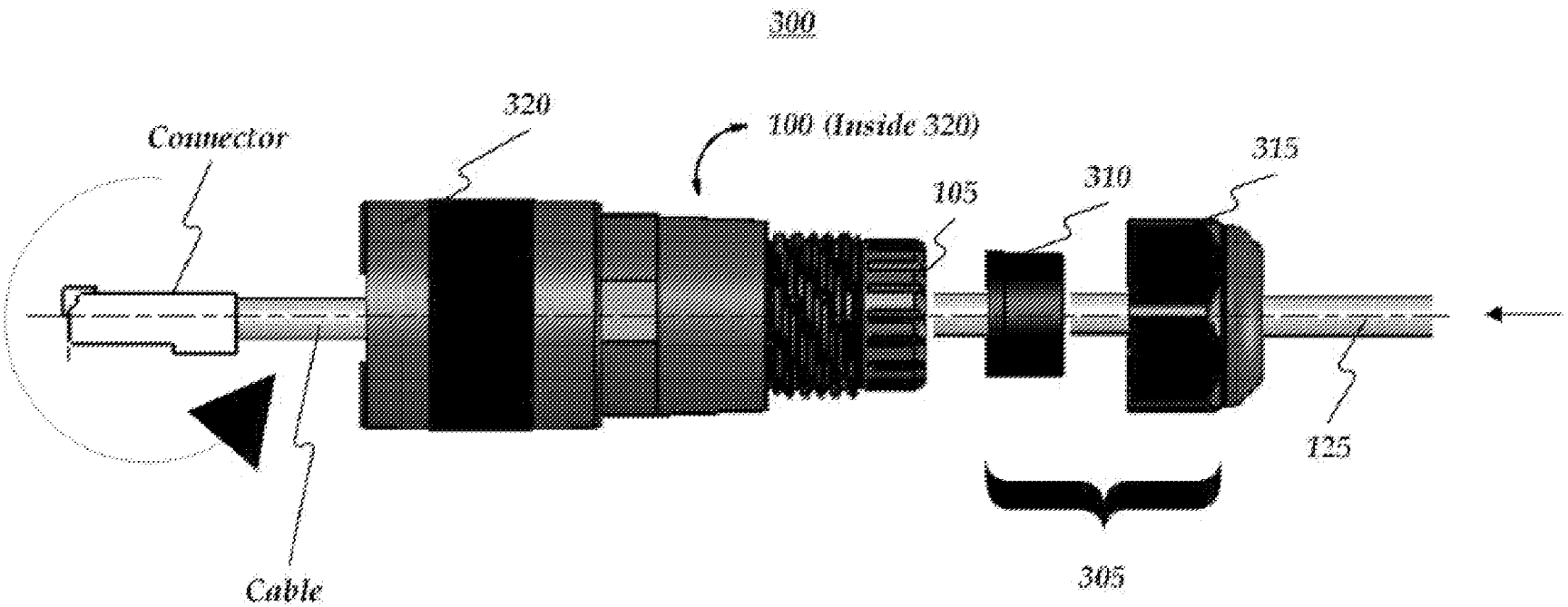
FIG. 3 is a diagram of a plug.

FIG. 3 shows a diagram of a plug 300 consistent with an embodiment of the invention. In addition to body 100 (described above), plug 300 may include a tensioning component 305. Tensioning component 305 may be configured to hold the connector in the at least one recess substantially stationary with respect to body 100 when a force is applied to a cable attached to the connector. The force may be applied in a direction from second end 110 of body 100 to first end 105 of body 100. Tensioning component 305 may comprise a grommet 310 configured to hold the cable substantially stationary with respect to body 100 and to maintain a tension to provide the force on the cable. Furthermore, tensioning component 305 may comprise a nut 315 configured to hold grommet 310 substantially stationary with respect to body 100.

Moreover, plug 300 may include a coupling nut 320. Coupling nut 320 may be located at second end 110 of body 100. Furthermore, coupling nut 320 may be configured to attach to a receptacle (not shown) to form, for example, a dust resistant and/or water resistant seal between plug 300 and the receptacle. A portion of body 100 may be contained within coupling nut 320.

Figure 4:
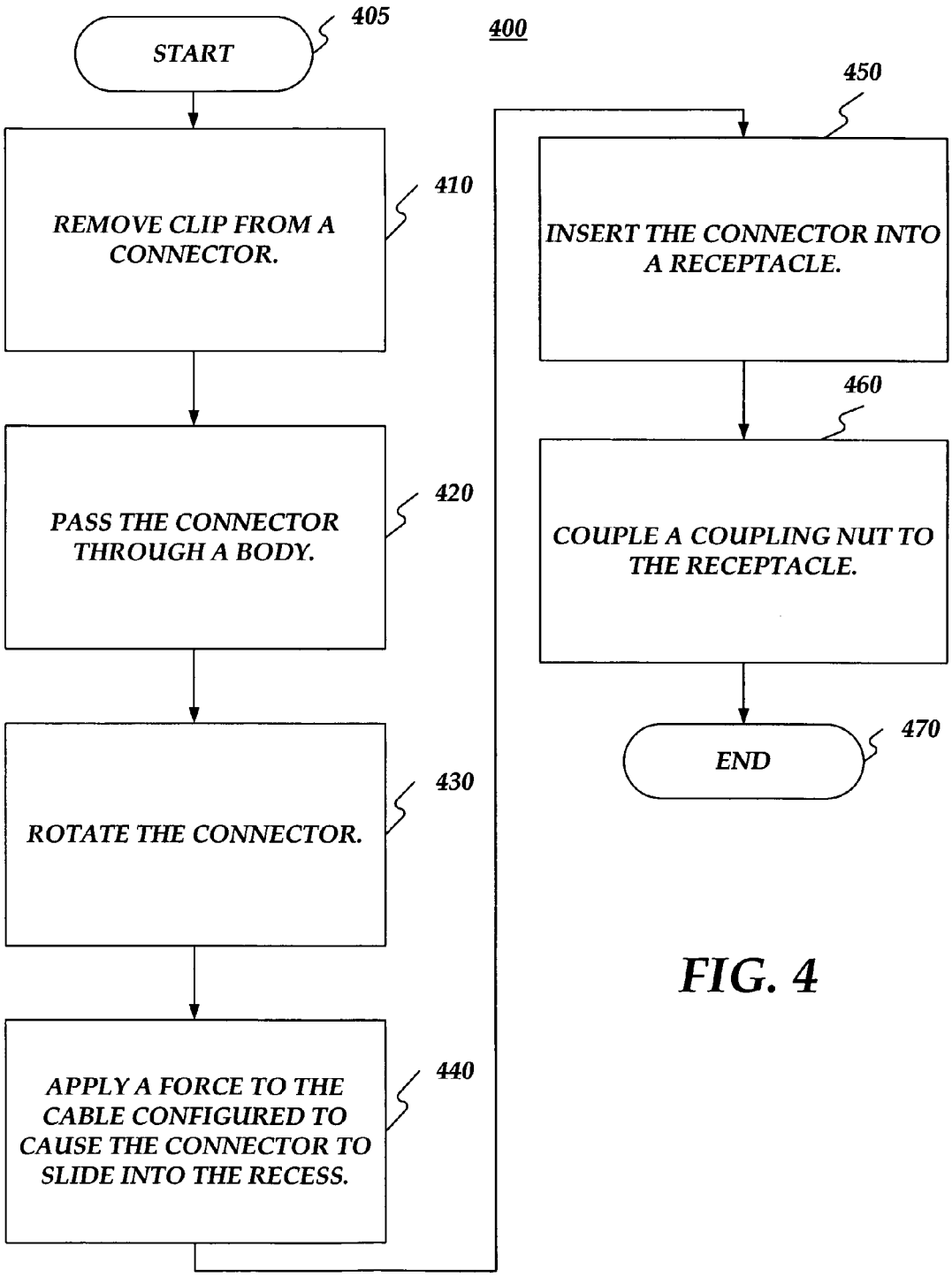
FIG. 4 is a flow chart of a method for providing a field wireable network connection.
Figure 5A:
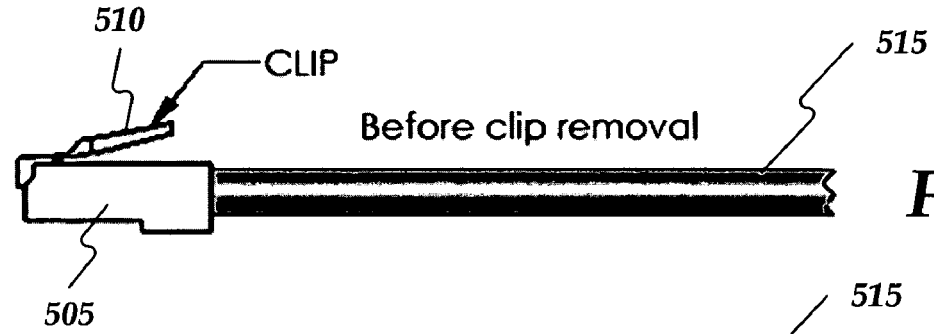
FIGS. 5A through 5B are diagrams showing a connector and cable combination.
Figure 5B:
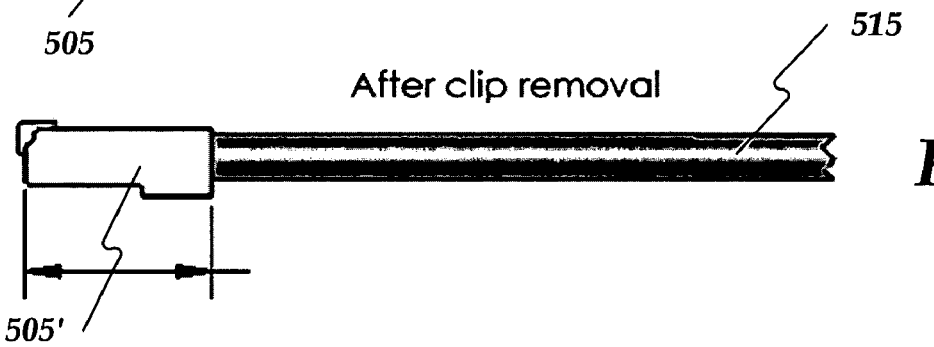

FIG. 4 is a flow chart setting forth the general stages involved in a method 400 consistent with an embodiment of the invention for providing a field wireable network connection. Method 400 may be implemented using plug 300 as described in more detail above with respect to FIG. 3. Ways to implement the stages of method 400 will be described in greater detail below. Method 400 may begin at starting block 405 and proceed to stage 410 where a user may remove a clip 510 from a connector 505 as shown in FIGS. 5A and 5B. For example, connector 505 may be connected to a cable 515. FIG. 5B shows a connector 505' comprising, for example, connector 505 with clip 510 removed. While clip 510 may be removed consistent with embodiments of the invention, clip 510 may, however, have been configured to hold connector 505 in a receptacle (not shown). The at least one recess, as described above with respect to body 100, may be configured to receive connector 505' into the at least one recess when clip 510 is removed from connector 505.

Cable 515 may be pre-made and purchased by the user with connector 510 already installed. Accordingly, the combination connector 510 and cable 515 may be, for example, pre-tested, pre-certified, and purchases off-the-shelf by the user. For example, the combination connector 510 and cable 515 may be pre-tested and certified as at least being one of category 3, category 4, category 5, category 5*e*, category 6, and category 7, or any other category. Cable 515 may include at least one of an optical fiber and/or a twisted pair. The aforementioned are examples and cable 515 may include any cable configuration. Furthermore, connector 510 may comprise any connector type including, for example, RJ-11, RJ-12, and RJ-45.

From stage 410, where the user removes clip 510 from connector 505, method 400 may advance to stage 420 where the user may pass connector 505' through body 100 past second end 110. In this case, connector 505' may pass through nut 315 (e.g. a dome nut) and grommet 310 may be applied around cable 515. Once the user passes connector 505' through body 100 in stage 420, method 400 may continue to stage 430 where the user may rotate connector 505' to line up with recesses 120*a* and 120*b*. For example, the user may rotate connector 505' approximately 90 degrees. Depending on the size, shape, or orientation of the at least one recess, however, the user may rotate connector 505' any amount and is not limited to 90 degrees.

Figure 6:
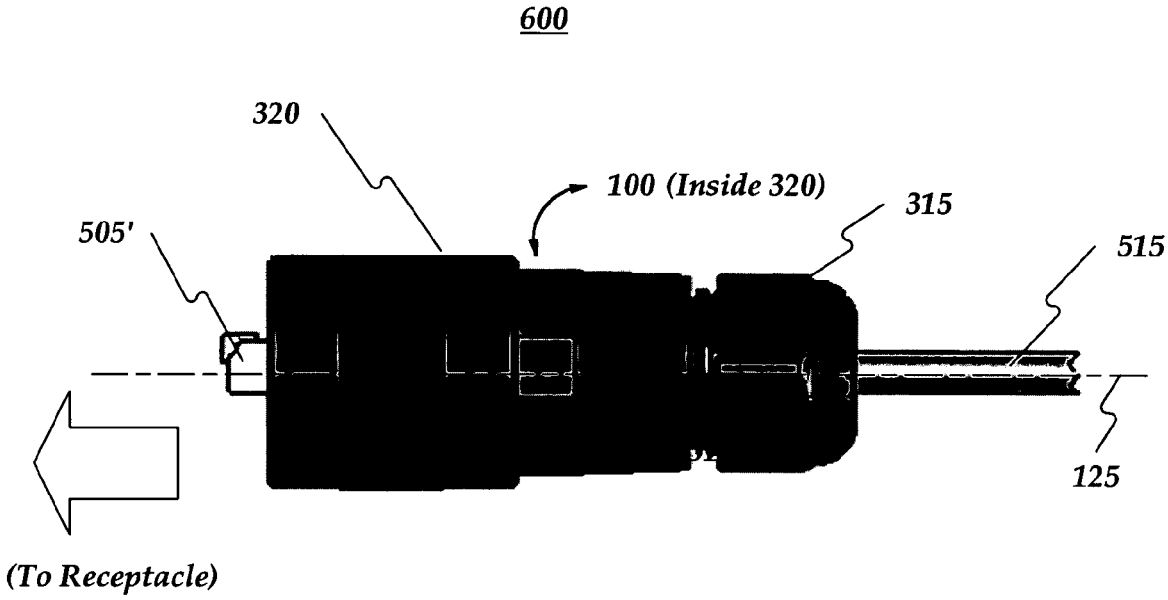
FIG. 6 is a diagram of a plug with a cable installed.

After the user rotates connector 505' in stage 430, method 400 may proceed to stage 440 where the user may apply a force to cable 515. In other words, once connector 505' is past second end 110, connector 505' may be rotated and pulled back through body 100 for a distance until it seats into the at least one recess. For example, the force may be configured to cause connector 505' to slide into the at least one recess. The force may be applied in a direction from second end 110 of body 100 to first end 105 of body 100. The force may be maintained by grommet 310 configured to hold cable 515 substantially stationary with respect to body 100. Nut 315 may then be tightened to seal around cable 515 and may prevent movement of connector 505'. In other words, grommet 310 may maintain a tension on cable 515 to provide the force. Grommet 310 may be held substantially stationary with respect to body 100 by nut 315. FIG. 6 shows a diagram of an assembled plug 600. Plug 600 may comprise plug 300, shown in FIG. 3, with cable 515 installed.

Once the user applies the force to cable 515 in stage 440, method 400 may proceed to stage 450 where the user may insert connector 505' into a receptacle. After the user inserts connector 505' into the receptacle in stage 450, method 400 may proceed to stage 460 where the user may couple coupling nut 320 to the receptacle. For example, once attached, coupling nut 320 attached to the receptacle may form a dust resistant and/or water resistant seal between plug 600 and the receptacle. Consequently, an inexpensive dust resistant and/or water resistant seal may be formed using a pre-certified off-the-shelf cable designed, for example, for office use. Once the user couples coupling nut 320 to the receptacle in stage 460, method 400 may then end at stage 470.

Figure 7:
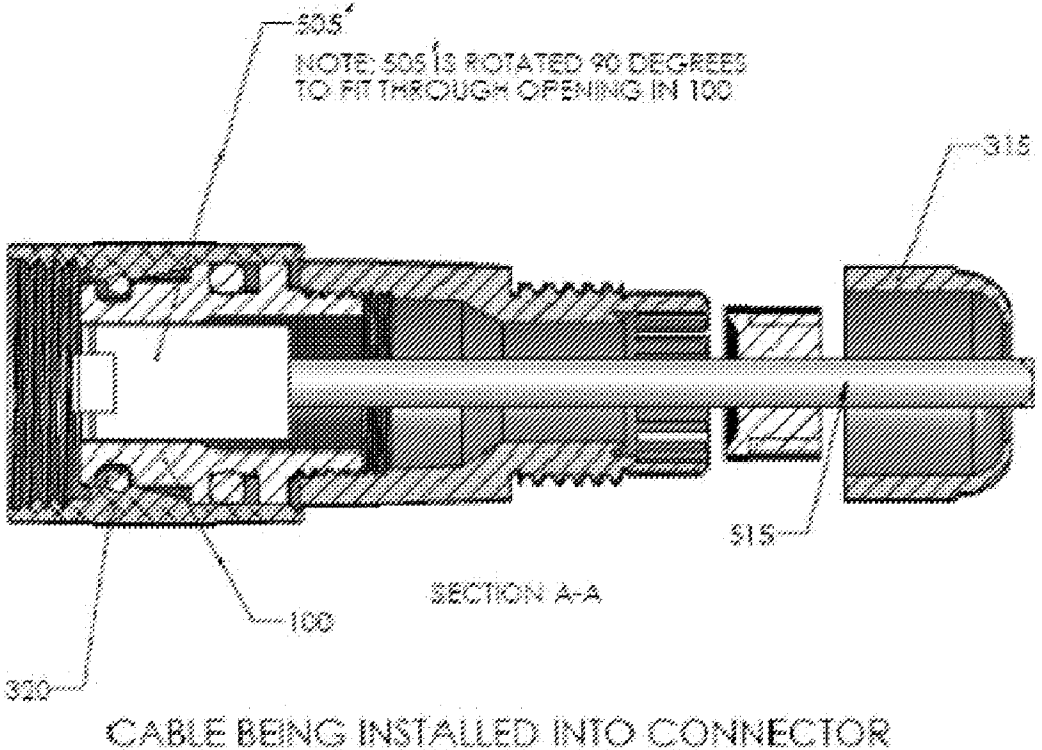
FIG. 7 illustrates the connector as it passing through the body.
Figure 7:
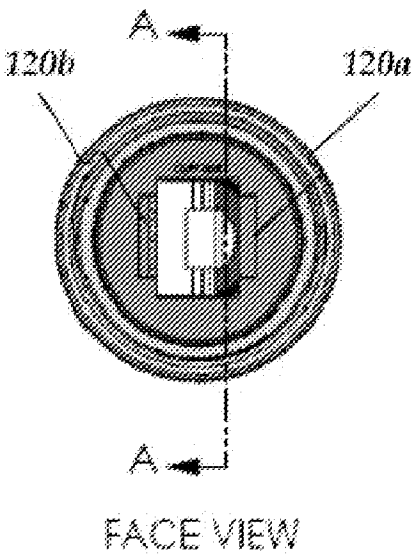
Figure 8:
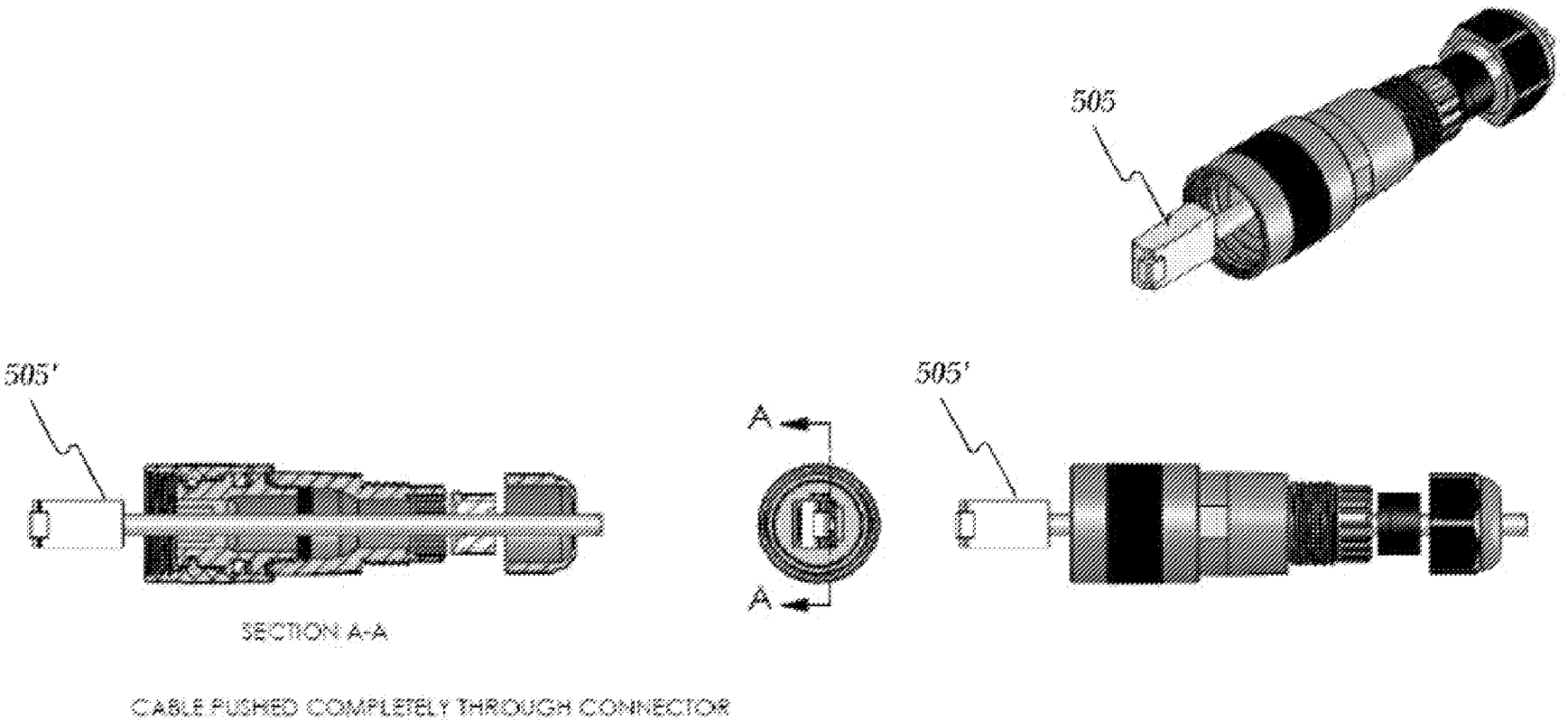
FIG. 8 illustrates the connector after it has passed through the body.
Figure 9:
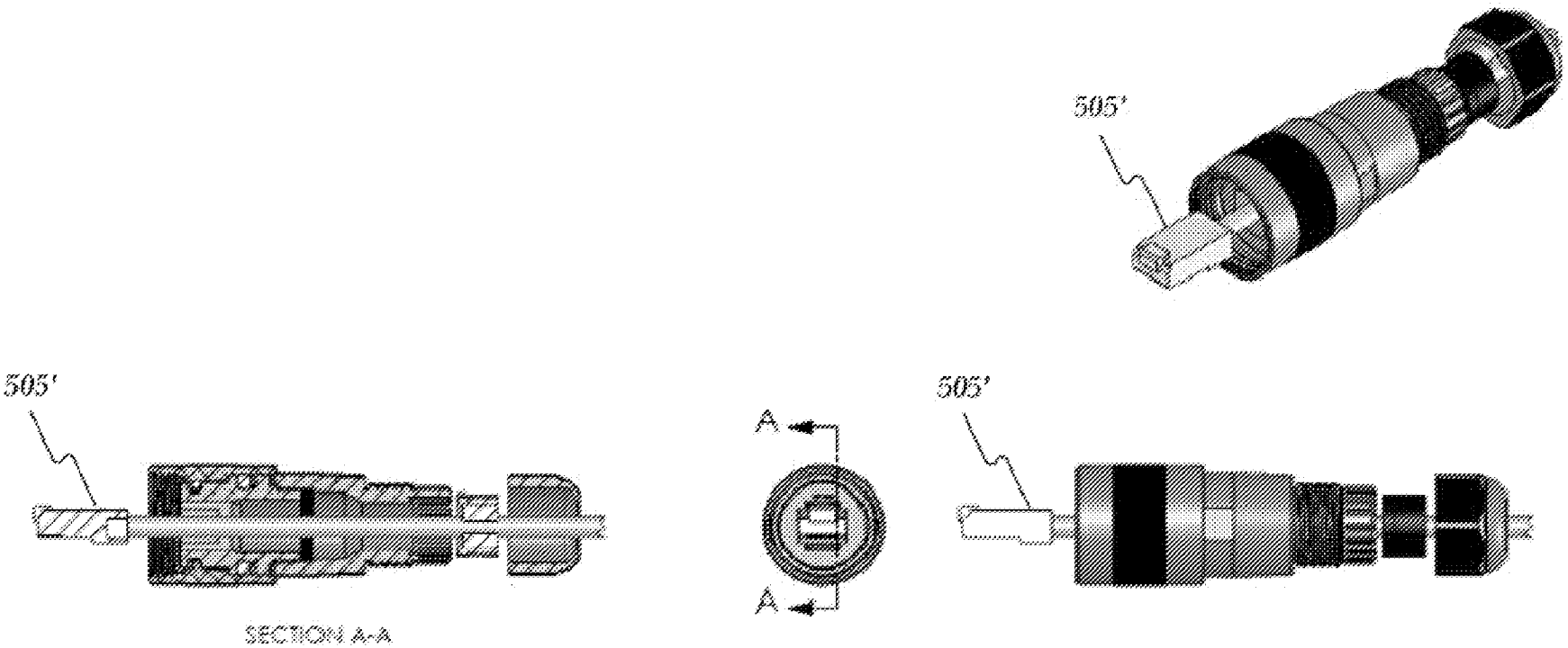
FIG. 9 illustrates the connector after it has passed through the body and has been rotated.
Figure 10:
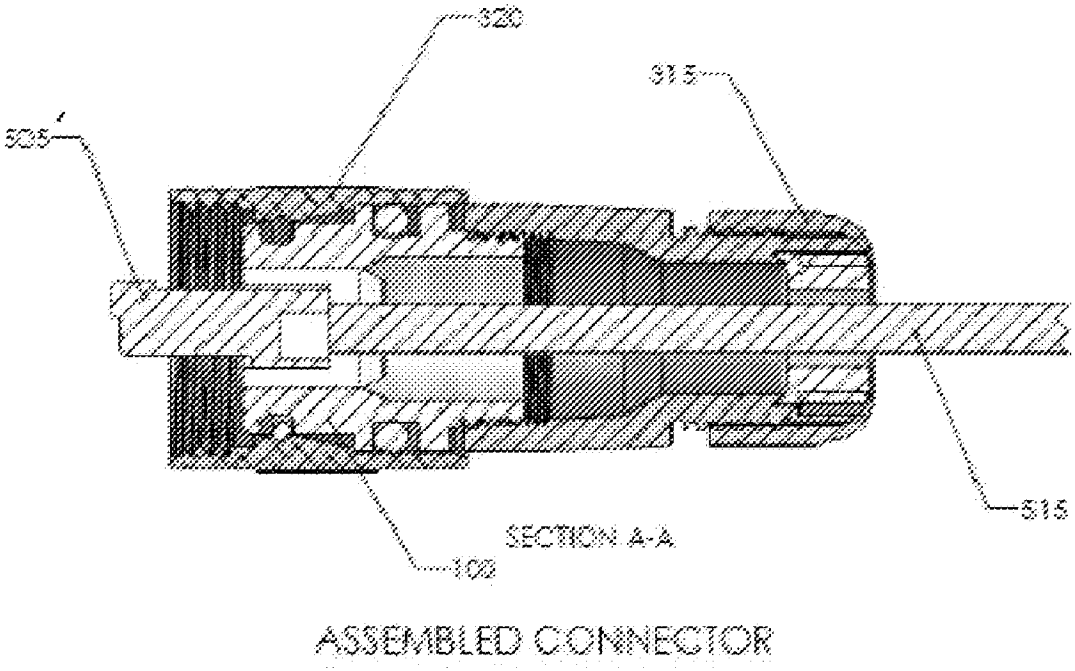
FIG. 10 illustrates the connector after it has been rotated and pulled back into the body.
Figure 10:
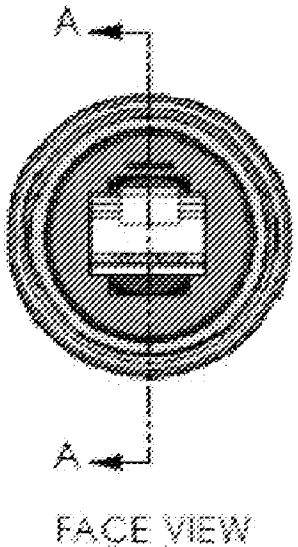

FIGS. 7 through 10 illustrate body 100 from FIG. 1 with respect to stages described above from method 400. FIG. 7 illustrates connector 505' as it passing through body 100 (stage 420.) FIG. 8 illustrates connector 505' after it has passed through body 100 (stage 420.) FIG. 9 illsutrates connector 505' after it has passed through body 100 and has been rotated (stage 430.) FIG. 10 illustrates connector 505' after it has been rotated and pulled back into body 100 (stage 440.)

Embodiments of the present invention, for example, are described above with reference to block diagrams and/or operational illustrates of methods and systems, according to embodiments of the invention. The functions/acts noted in the blocks may occur out of the order as show in any flowchart. For example, two blocks shown in succession may in fact be executed substantially concurrently or the blocks may sometimes be executed in the reverse order, depending upon the functionality/acts involved. While certain embodiments of the invention have been described, other embodiments may exist. Further, the disclosed methods' stages may be modified in any manner, including by reordering stages and/or inserting or deleting stages, without departing from the invention.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A field wireable network plug comprising:

a body having a first end and a second end, the body comprising:

an opening passing through the body from the first end of the body to the second end of the body, the opening configured to allow a connector to pass through the opening from the first end of the body to the second end of the body; and at least one recess into the body at the second end of the body, the at least one recess configured to restrict the connector from moving through the opening from the second end of the body to the first end of the body wherein the at least one recess is configured to restrict the connector from moving through the opening from the second end of the body to the first end of the body when the connector is rotated and partially seated in the at least one recess after the connector moves past the second end.

2. The plug of claim 1, wherein the at least one recess is configured to restrict the connector from moving through the opening from the second end of the body to the first end of the body when the connector is rotated about an axis passing through the body from the first end of the body to the second end of the body through the opening.

3. The plug of claim 2, wherein the at least one recess is configured to restrict the connector from moving through the opening from the second end of the body to the first end of the body when the connector is rotated approximately 90 degrees.

4. The plug of claim 1, wherein the at least one recess is configured to hold the connector substantially stationary with respect to the body when a force is applied to the connector in a direction from the second end of the body to the first end of the body.

5. The plug of claim 1, wherein the at least one recess is configured to hold the connector substantially stationary with respect to the body when a force is applied to a cable attached to the connector, the force being applied in a direction from the second end of the body to the first end of the body.

6. The plug of claim 5, wherein the cable includes at least one of the following: an optical fiber, a copper wire, and a twisted pair.

7. The plug of claim 1, wherein the at least one recess is configured to receive the connector when a clip is removed from the connector.

8. The plug of claim 1, wherein the at least one recess is configured to receive the connector comprising an RJ type connector.

9. A field wireable network plug comprising:

a body having a first end and a second end, the body comprising, an opening passing through the body from the first end of the body to the second end of the body, the opening configured to allow a connector to pass through the opening from the first end of the body to the second end of the body, and at least one recess into the body at the second end of the body, the at least one recess configured to restrict the connector from moving through the opening from the second end of the body to the first end of the body wherein the at least one recess is configured to restrict the connector from moving through the opening from the second end of the body to the first end of the body when the connector is rotated about an axis passing through the body from the first end of the body to the second end of the body through the opening; and a tensioning component configured to hold the connector in the at least one recess and substantially stationary with respect to the body when a force is applied to a cable attached to the connector, the force being applied in a direction from the second end of the body to the first end of the body.

10. The plug of claim 9, wherein the tensioning component comprises:

a grommet configured to hold the cable substantially stationary with respect to the body and to maintain a tension to provide the force on the cable.

11. The plug of claim 10, wherein the tensioning component comprises a nut configured to hold the grommet substantially stationary with respect to the body.

12. The plug of claim 9, further comprising a coupling nut at the second end of the body configured to attach to a receptacle to form a dust resistant and water resistant seal between the plug and the receptacle.

13. The plug of claim 9, wherein the cable includes at least one of the following: an optical fiber, a copper wire, and a twisted pair.

14. The plug of claim 9, wherein the at least one recess is configured to receive the connector into the at least one recess when a clip is removed from the connector.

15. The plug of claim 9, wherein the at least one recess is configured to receive the connector comprising RJ type connector.

16. The plug of claim 15, wherein the at least one recess is configured to restrict the connector from moving through the opening from the second end of the body to the first end of the body when the connector is rotated approximately 90 degrees.

17. The plug of claim 9, wherein the at least one recess is configured to hold the connector substantially stationary with respect to the body when a force is applied to the connector in a direction from the second end of the body to the first end of the body.

* * * * *